US007090794B2

(12) United States Patent
Pedersen

(10) Patent No.: US 7,090,794 B2
(45) Date of Patent: Aug. 15, 2006

(54) METHOD OF PREPARING A MINERAL FIBER PANEL COMPRISING ONE OR MORE SHAPED CAVITIES

(75) Inventor: Ole Løgtholt Pedersen, Frederiksberg C (DK)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 10/363,642

(22) PCT Filed: Aug. 24, 2001

(86) PCT No.: PCT/DK01/00559

§ 371 (c)(1),
(2), (4) Date: Mar. 4, 2003

(87) PCT Pub. No.: WO02/20890

PCT Pub. Date: Mar. 14, 2002

(65) Prior Publication Data

US 2003/0175486 A1 Sep. 18, 2003

(30) Foreign Application Priority Data

Sep. 4, 2000 (DK) ..... 2000 01315

(51) Int. Cl.
*B27N 5/00* (2006.01)

(52) U.S. Cl. ..... 264/118; 264/112; 264/119

(58) Field of Classification Search ..... 264/119, 264/118, 112, 113, 320, 323
See application file for complete search history.

(56) References Cited

U.S. PATENT DOCUMENTS

| | | | | |
|---|---|---|---|---|
| 3,147,165 | A * | 9/1964 | Slayter | 156/62.2 |
| 3,654,053 | A | 4/1972 | Toedler | 428/56 |
| 4,073,230 | A * | 2/1978 | Akerson | 101/32 |
| 4,353,949 | A * | 10/1982 | Kyminas et al. | 428/195.1 |
| 4,608,108 | A * | 8/1986 | Goll | 156/219 |
| 4,698,257 | A * | 10/1987 | Goll | 428/171 |
| 5,639,411 | A * | 6/1997 | Wilkins et al. | 264/145 |
| 5,743,985 | A * | 4/1998 | Ernest et al. | 156/243 |

FOREIGN PATENT DOCUMENTS

| | | |
|---|---|---|
| DE | 3535490 | 4/1987 |
| DE | 3737416 | 5/1989 |
| WO | 8800265 | 1/1988 |

* cited by examiner

*Primary Examiner*—Mary Lynn Theisen
(74) *Attorney, Agent, or Firm*—Dykema Gossett PLLC

(57) ABSTRACT

The invention relates to a method of preparing a mineral fiber comprising one or more shaped cavities and a mineral fiber panel prepared by the method and an apparatus for preparing mineral fiber panels comprising one or more shaped cavities. Furthermore the invention relates to uses of the mineral fiber panel comprising one or more shaped cavities.

41 Claims, 11 Drawing Sheets

METHOD OF PREPARING A MINERAL FIBER PANEL COMPRISING ONE OR MORE SHAPED CAVITIES

BACKGROUND OF THE INVENTION

Field of the Invention

A method of preparing a mineral fiber panel comprising one or more shaped cavities, mineral fiber panels comprising one or more shaped cavities and an apparatus for preparing mineral fiber panels comprising one or more shaped cavities, and use of the mineral fiber panel comprising one or more shaped cavities.

The invention relates to a method of preparing a mineral fiber panel comprising one or more shaped cavities and a mineral fiber panel prepared by the method and an apparatus for preparing mineral fiber panels comprising one or more shaped cavities. Furthermore, the invention relates to uses of the mineral fiber panel comprising one or more shaped cavities.

Mineral fiber panels comprising shaped cavities that e.g., allow water to flow freely in the panel, are normally used for specific purposes such as drainage aids or plant growth medias. The panels according to the invention are also very useful for many insulation purposes, e.g., facade insulation and technical insulation. The shaped cavity referred to in the present application is defined as a cavity in the panel which is larger than the natural formed cavities normally present in mineral fiber material. The shaped cavities are usually shaped as tubular shaped cavities in the panels.

In the known panels comprising shaped cavities, these shaped cavities are normally formed by drilling or cutting in the panel. One known type of panels is produced by cutting a groove in one mineral fiber board and then apply another mineral board or vlies to form a panel comprising shaped cavities in the panel.

Generally all known panels comprising shaped cavities suffer from the disadvantage that the shaped cavities have to be prepared by after-treatment, such as drilling or cutting, of the panels. The necessary after-treatment makes the preparation of the panels expensive and complicated.

There has therefore been a need for providing a method of producing panels with one or more shaped cavities which method does not suffer from the above-described drawbacks.

The object of the present invention is thus to provide such method, and in particular a method of producing panels with one or more shaped cavities, it being simple, effective, and resulting in a product of high quality.

SUMMARY OF THE INVENTION

The invention provides a method by which a panel comprising one or more shaped cavities can be prepared in one step, during the manufacture of the mineral fiber panel, without need for after-treatment of the panel. Furthermore, the invention provides the possibility that different kinds of products may be produced at the same time by placing different kinds of moulding pieces in different sections of the web.

The invention also provides an apparatus for preparing panels comprising one or more shaped cavities, which apparatus allows the one or more shaped cavities to be formed during the manufacture of the mineral fiber web from which the panels may be cut.

Furthermore the invention provides panels comprising one or more shaped cavities obtained by the method according to the invention, which panels have improved qualities and performance compared to known panels comprising shaped cavities.

The invention also comprises use of the mineral fiber panels according to the invention.

The method and apparatus according to the invention provide an uncomplicated and cost-effective method of producing mineral fiber panels comprising one or more shaped cavities, and the produced panels have improved qualities, particularly with respect to their ability to keep shape and durability.

The advantages of the method according to the invention compared to the known methods are e.g. its simplicity, the amount of dust and waste caused by the production method being significantly reduced and moreover the production equipment is cheap and the maintenance costs are low.

All these advantages result in that the costs of making shaped cavities are very low compared to the known methods.

The fibre structure formed around the moulding piece gives: a laminar layer orientation of the mineral fibres, a higher density and better delamination properties.

This results in better lambda values (insulation properties), greater resistance against water absorption and better mechanical properties in the product.

The method of preparing a mineral fiber panel comprising one or more shaped cavities according to the invention comprises the steps of i) providing a mineral fiber web comprising unhardened or uncured binding agent and convoying the mineral fiber web in the longitudinal direction, which is defined as the direction in which the web has the longest extension, ii) pressing one or more moulding pieces into the web, preferably by placing the moulding piece(s) into the surface and compressing the part of the web containing the moulding piece(s) in the surface, and/or pressing one or more moulding pieces into the body of the web, preferably by dividing the web into two sub-webs, placing the moulding piece(s) between the sub-web and compressing the part of the web containing the moulding piece(s) between the sub-webs, said one or more moulding pieces forming one or more shaped cavities in the final web, iii) optionally further compressing at least a part of the web, preferably the part of the web containing the one or more moulding pieces, iv) hardening or curing the binding agent, and v) optionally cutting the hardened or cured final web into panels.

As it is clear from the above, the essential feature of the invention is the use of moulding pieces which are pressed into the mineral fiber web, preferably by compression, before or simultaneously with the curing or hardening of the web and preferably while the moulding pieces are still present in the web. It has appeared as an advantage that the web is hardened or cured faster when the moulding pieces are present in the web. This is particularly the case when the moulding pieces are placed in the lower surface of the web. Preferably the moulding pieces are present in the web when the web enters the hardening or curing oven and the moulding pieces remain present in the web at least in a part of the hardening or curing oven. Hereafter the web may slide off the moulding pieces leaving shaped cavities in the web.

The final compression of the web is important to the properties, and normally it is preferred to avoid compression on the web, when the moulding pieces are not present in the web any more. The moulding pieces will be described in details later.

For some embodiments of the invention it is an advantage to pre-compress the web before the moulding pieces are placed in the wool. This may facilitate the placing of the moulding pieces in the web.

The method according to the invention thereby provides a simple way of producing mineral fiber panels comprising shaped cavities as an on-line production.

The mineral fiber used in the method may be any man-made vitreous fiber MMVF, e.g. rock wool, glass wool, slag wool and the like. The mineral fibers may be produced in the traditional way, where the fibers from a spinner are mixed with binder and collected on a conveyer to form a continuous web. The density of the mineral fiber web and the mineral fiber panel produced according to the invention normally lies within the range 20–1000 kg/m$^3$. It is preferred that the density is less the 250 kg/m$^3$ and even more preferred less than 150 kg/m$^3$ where the cavities are to be formed.

The shaped cavities produced by the method may have almost any shape, but for many purposes the preferred form of the shaped cavities is grooves in the surface of the panels and tubular or pipeline-like cavities within the panels. Those grooves tubular shaped cavities are preferably parallel to one of the edges of the panel.

In a preferred embodiment of the method according to the invention, the method comprises the steps of:

i) providing at least two mineral fiber sub-webs comprising unhardened or uncured binding agent and convoying the sub-webs in the longitudinal direction, The sub-webs may be provided by dividing a mineral fiber web into at least two sub-webs by passing the web through one or more dividing tools perpendicular to the longitudinal direction of the web and convoying said sub-webs in their longitudinal directions. The sub-webs may also be provided from different production lines and e.g. constitute sub-webs with different properties. The properties may e.g. be that one sub-web is hydrophilic and the other sub-web is hydrophobic. Moreover the web or sub-webs may be impregnated with dye-stuff, oil, fungicides and additives that will make the panel hydrophobic or hydrophilic, etc., before they are exposed to the moulding pieces and compression.

ii) optionally compressing one or more of said at least two sub-webs, iii) bringing said at least two sub-webs together to form a layered web and placing one or more moulding pieces in or into the surface(s) of said sub-webs and/or in or into the interface(s) between said sub-webs, preferably compressing the part of the layered web containing the one or more moulding pieces, said one or more moulding pieces forming one or more shaped cavities in the layered web, iv) optionally further compressing the layered web, preferably the part of the layered web containing the one or more moulding pieces, v) hardening or curing the binding agent, and vi) optionally cutting the hardened or cured layered web into panels.

By using the above-preferred embodiment of the method it is possible to produce mineral fiber panels with layers of different densities and thickness. Moreover the panels may have shaped cavities in the surface constituting grooves and in the body of the web constituting tubes. If more than two sub-webs are used in the method according to the invention, not all of the sub-webs need to be exposed to the moulding piece(s). According to the method it is possible to produce grooves in the surface and tubular cavities in the body of a mineral fiber panel simultaneously.

The grooves in the surface of the panels may be produced by one preferred embodiment of the method according to the invention which comprises the step of bringing the upper and/or lower surface of the web or the layered web in contact with one or more moulding pieces to form one or more shaped cavities in the upper and/or lower surface of the web or the layered web, as the part of the web or the layered web containing the one or more moulding pieces are compressed before or simultaneously with the web or the layered web is cured or hardened.

In this connection the terms upper and lower surface have the following meaning. The upper surface is defined as the outer surface of the web facing upwards and the lower surface is defined as the outer surface of the web facing downwards. The upper and lower surface is connected by two edges, one in each side of the web.

A preferred embodiment of the method according to the invention comprises the steps of dividing the web into two or more sub-webs and preferably introducing one or more moulding pieces in the interface between each sub-web forming a layered web, said one or more moulding piece forming cavities in said layered web, preferably as the part of the layered web containing the one or more moulding pieces is compressed.

In this embodiment of the method it is possible to produce panels comprising shaped cavities constituted within layers of different thickness and preferably different densities. Of course the layers also may have the same thickness and properties.

As the method according to the invention is carried out it is preferred that the layered web containing the moulding pieces is compressed with rollers or with the lamellas of the hardening or curing oven. The last may reduce the production costs.

Furthermore in the method according to the invention it is preferred that the one or more shaped cavities are formed in the web or the layered web extending substantially in the longitudinal direction of the web or the layered web. The purpose of this is to optimize the conditions for on-line production.

In one particularly preferred embodiment of the method according to the invention the one or more moulding pieces have a substantially tubular shape for the purpose of making the one or more shaped cavities in the web or the layered web substantially tubular. The resulting product of the method is widely useful e.g. for drainage purposes and for installing electric or sanitary installations in the insulation panels.

In one embodiment of the method according to the invention the one or more moulding pieces have a varying cross section area, preferably a cross section area varying between 10–90000 mm$^2$, the moulding pieces thus having a conical shape or the moulding piece tapering from one end to the other.

In another embodiment of the method according to the invention one or more moulding pieces have an average cross section area, preferably a cross section area varying between 10–90000 mm$^2$. The cross section area between 10–90000 mm$^2$ reflects the most common sizes which is preferred for shaped cavities in mineral fiber panels.

As previously mentioned the method according to the invention allows that the one or more moulding pieces to have any desired shape of the cross section. Thus the one or more moulding pieces may have a circular, a half-circular, an oval, a half-oval, a rectangular, a quadrangular, a triangular, a polygon or star-formed shape of the cross section.

Furthermore the method according to the invention allows that the moulding pieces are made from any suitable material, therefore the one or more moulding pieces can be made from metal such as steel or iron, rubber, plastic, fluorocarbon, bakelit, natural or artificial fibres, ceramics and combinations of those materials and may optionally be coated with fluorocarbon and/or optionally armed with fibers. Fluor-carbon is a strong and heat resistant material which gives a smooth non-sticky surface. Fluor-carbon is e.g. sold under the trademark Teflon by the company DuPont. The use of fibers improves the strength of the moulding pieces. The natural or artificial fiber may be hemp or nylon and the moulding pieces may simply be ordinary ropes.

In an embodiment of the method according to the invention the one or more moulding pieces are fastened to a support device placed between the convoying means transporting a first and a second sub-web and if more sub-webs optionally between the convoying means transporting the sub-webs and perpendicular to the direction of the sub-webs and immediately before the sub-webs are brought together to form a layered web, said one or more moulding pieces extending from the support device in the direction of and parallel to the plane defined by the layered web. Thus the moulding pieces are able to make shaped cavities in the body of the layered web.

In another or connected embodiment of the method according to the invention at least a number of said moulding pieces are fastened to one or more support devices placed above and/or under the web or the layered web. According to this embodiment the moulding pieces make shaped cavities in the surface(s) of the web.

In order to optimize the production in one preferred embodiment of the method according to the invention one or more moulding pieces are fastened perpendicular to said support device, if more than one moulding piece, the moulding pieces preferably being mutually parallel.

In a particularly preferred embodiment of the method according to the invention liquid and/or gas can be led to the web or the layered web through holes and/or nozzles in one or more of the moulding pieces. In this way it is possible to apply e.g. extra binder or oil or other additives to the web via the moulding pieces. Furthermore it is possible to send hot steam into the web which may pre-cure or pre-harden the web. It is also a possibility to draw hot air from the hardening or curing oven into the moulding piece with the use of suction means. This will increase the amount of hot air around the moulding piece during the hardening or curing process.

Moreover the one or more moulding pieces are heated or cooled in a preferred embodiment of the method according to the invention. The heated moulding pieces can also be used for pre-hardening or pre-curing the surrounding web-material which is desirable for some purposes e.g. it will give more stable shaped cavities.

For the purpose of producing panels comprising shaped cavities with special properties a preferred embodiment of the method according to the invention includes that the one or more moulding pieces rotate and/or move forwards and back in a direction preferably parallel to the direction of the web or the layered web and/or vibrate.

In a preferred embodiment of the method according to the invention the part of the web or the layered web which contains the one or more moulding pieces is compressed at the entrance to and/or in the hardening or curing oven.

In order to make panels for special or specific uses a preferred method according to the invention includes that the upper surface and/or the lower surface of the web or the layered web is coated with a woven or non-woven vlies, net, metal foil or a layer of mineral material, preferably mineral material containing binder. The coating material may also be applied to the internal surfaces within the panel and the coating material may be any combination of the before mentioned possibilities.

Furthermore in order to make panels for special or specific uses a preferred embodiment of the method according to the invention also includes that the web or the layered web is divided in the longitudinal direction after the hardening or curing oven. The cut in the longitudinal direction may both be horizontal or vertical or with an inclination, and it is e.g. possible to produce panels with grooves in the surface from a web with shaped cavities in the body.

The produced panels may also be glued together to form various forms of mineral fiber panels with shaped cavities.

The invention also comprises a mineral fiber panel comprising one or more shaped cavities in the panels obtainable by the method according to the invention.

In a preferred embodiment of the mineral fiber panel according to the invention the one or more surrounding zones, defined as the layers of mineral fibers constituting the surface of the one or more shaped cavities, are compressed to a density which is higher than the average density of the total mineral fiber panel, preferably said one or more surrounding zones having a thickness measured from the surface of the one or more shaped cavities of at least 0,2 cm. The zones are important as the strength of the panel is improved due to those zones. Because of the zones the mineral fiber panels according to the invention differ from any known mineral fiber panel with shaped cavities and give the panels improved and unique qualities, e.g. the panel according to the invention has significantly improved bending strength compared the known panels.

In order to produce one of the most useful embodiments of the mineral fiber panel according to the invention, a panel is produced in which one or more shaped cavities are substantially tubular-shaped and preferably parallel to one edge of the panel. Such a panel is useful for many purposes.

Furthermore mineral panels according to the invention can be prepared with grooves in the surface which e.g. may be useful to fit in latches and the like in the panel.

The invention also comprises an apparatus for preparing a mineral fiber panel comprising one or more shaped cavities in the panel, which apparatus comprises:

i) means to convey a mineral fiber web comprising unhardened or uncured binding agent in the longitudinally direction, ii) one or more moulding pieces to form one or more shaped cavities in the web, iii) optionally rollers or other compression means to compress the web, preferably the part of the web containing the one or more moulding pieces, iv) a hardening or curing oven to harden or cure the web and/or simultaneously compressing the part of the web containing the one or more moulding piece, and v) optionally cutting means to cut the web into panels.

A preferred embodiment of the apparatus according to the invention comprises:

i) means to convey a mineral fiber web comprising unhardened or uncured binding agent in the longitudinally direction, ii) one or more dividing tools to divide the mineral web into at least two sub-webs and means for convoying the sub-webs in their longitudinally direction, iii) optionally rollers or other compression means to compress one or more of the at least two sub-webs, iv) convoying means to bring the at-least two sub-webs together to form a layered web and placing and/or pressing one or more moulding pieces in or into the surface(s) of said sub-webs and/or in or into the interfaces between said sub-webs, v) rollers or other means to compress the layered web, preferably the part of the layered web containing the one or more moulding pieces, vi) a hardening or curing oven to harden or cure the layered web and/or simultaneously compress the part of the layered web containing the one or more moulding piece, and vii) optionally cutting means to cut the layered web into panels.

In the apparatus according to the invention it is preferred that the one or more moulding pieces in the interface(s) between said at least two sub-webs are fastened to a support device, and the support device is placed between the convoying means transporting the at least two sub-webs and preferably perpendicular to the direction of the layered web and immediately before the place where the at least two sub-webs are brought together and the one or more moulding pieces extend from the support device into the layered web and preferably parallel to the plane defined by the plane of the layered web.

Furthermore it is preferred that the apparatus according to the invention has at least a number of moulding pieces which are fastened to one or more support devices placed above and/or under the web or the layered web. The moulding pieces are useful for making shaped cavities in the surface(s) of the web.

It is preferred that the one or more moulding pieces if more than one moulding piece are fastened to the support device preferably being mutually parallel.

For the purpose of producing commonly used products a preferred embodiment of the apparatus according to the invention is constructed so that the one or more moulding pieces are substantially tubular in their longitudinal direction.

Of course the moulding pieces may have any desired shape of the cross section area. The one or more moulding pieces may have a circular, a half circular, an oval, a half-oval, a rectangular, a quadrangular, a triangular, a polygon or star-formed shape of the cross section, and preferably the cross section area of each moulding piece may vary between 10–90000 $mm^2$.

The moulding pieces may be produced from any suitable material, flexible or non-flexible and may preferably be made from metal such as steel or iron, rubber, plastic, fluor-carbon, bakelit, natural or artificial fibers, ceramics and combinations of those materials and may optionally be coated with fluorocarbon and/or optionally armed with fibers.

For the purpose of adding liquid or gas to the web it is preferred that the one or more moulding pieces are equipped with holes and/or nozzles.

Moreover the one or more moulding pieces may preferably be equipped with means for heating and/or cooling.

In order to achieve panels with special or specific properties a preferred embodiment of the apparatus according to the invention is equipped with one or more moulding pieces that are able to rotate and/or move forwards and back in a direction preferably parallel to the direction of the layered web and/or vibrate.

In a preferred embodiment of the apparatus according to the invention the apparatus comprises rollers or other compression means before the entrance to the hardening or curing oven.

It is preferred that the apparatus according to the invention comprises tools to divide the web into two or more sub-webs and one or more moulding pieces to be placed in the surfaces of the sub-webs. Thereby it is possible to produce panels comprising shaped cavities in the body. The tools used to divide the web may e.g. be knifes, saws or cutting treads.

For producing some special or specific products it is preferred that the apparatus according to the invention comprises means to apply woven or non-woven vlies, net, metal foil or a mineral material, preferably said mineral material containing binder, to the upper and/or the lower surface of the web and/or the interfaces between sub-webs. And of course the apparatus can be adapted to apply any combination of coating materials.

Furthermore it is preferred that the apparatus comprises means to divide the hardened or cured web or the hardened or cured layered web in the longitudinal direction, said means being placed after the hardening or curing oven. The dividing means may be knives, saws or threads or the like and is able to divide the panels horizontally, vertically or inclined.

The invention also comprises use of the mineral fiber panel obtained by the method according to the invention.

One preferred use is for installation of floor heating, pipes or hoses.

A second preferred use is for drainage purposes.

A third preferred use is for technical insulation.

A fourth preferred use is for sound and/or acoustic insulation.

A fifth preferred use is for ventilated roof or facade.

A sixth preferred use is for electric and/or sanitary installations.

A seventh preferred use is for growth media for plants e.g. for use on green roofs.

When a panel according to the invention is used for growth media for plants the web is normally hydrophilic and the shaped cavities are formed as cavities in the bottom of the panel. The shaped cavities are thus grooves which allow air to the roots of the plants.

BRIEF DESCRIPTION OF THE DRAWINGS

The invention will now be described with some examples and with reference to the drawing where.

DETAILED DESCRIPTION OF THE PREFERRED EMBODIMENTS

Figure 1:
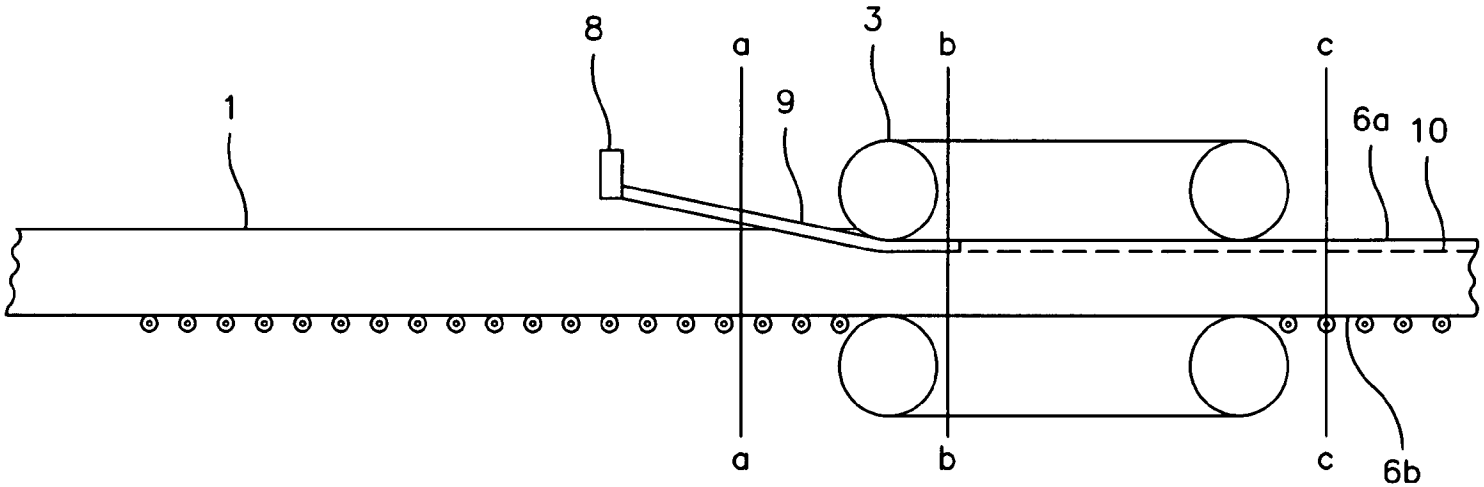
FIG. 1 shows an apparatus and process according to the invention for forming shaped cavities in the surface of a web.
Figure 1C:
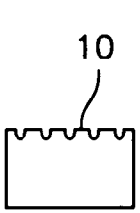
Figure 1B:
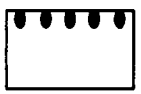
Figure 1A:
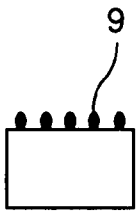

In FIG. 1 an apparatus for producing shaped cavities in mineral fiber panels is shown. A web 1 is convoyed in the direction of the compression means 3, and before the entrance to the compression means, moulding pieces 9 are placed in the surface of the web. The moulding pieces are fastened to a support device 8. The web 1 with the moulding pieces 9 is led to the compression means which compress on the upper surface 6*a* and the lower surface 6*b* of the web 1. Simultaneously with the compression the web is hardened or cured so the shaped cavities 10 in the upper surface of the web remain stable. In FIGS. 1*a*, 1*b* and 1*c* cuts in the web at position aa, bb and cc are shown.

Figure 2:
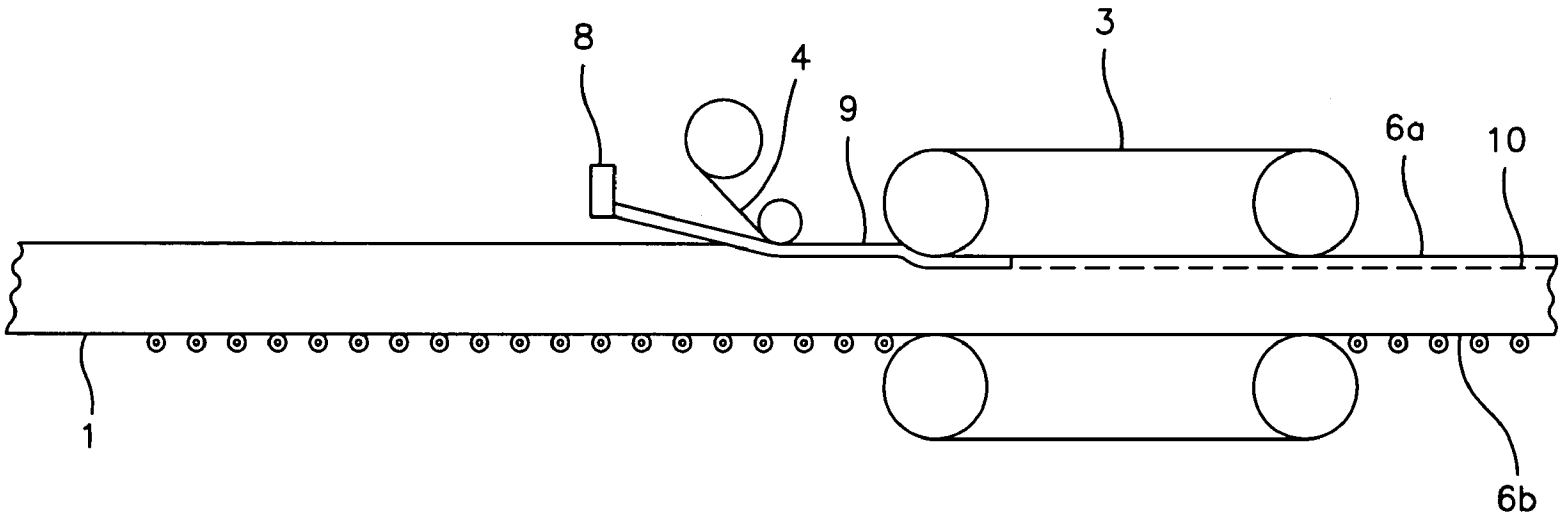
FIG. 2 shows the apparatus and process of FIG. 1 with the additional feature that a vlies is applied to the surface of the web.

In FIG. 2 a similar apparatus is shown. The apparatus in FIG. 2 has the additional feature to apply a vlies 4 to the upper surface 6*a* of the web. The resulting product thus has grooves in the surface covered with a vlies.

Figure 3:
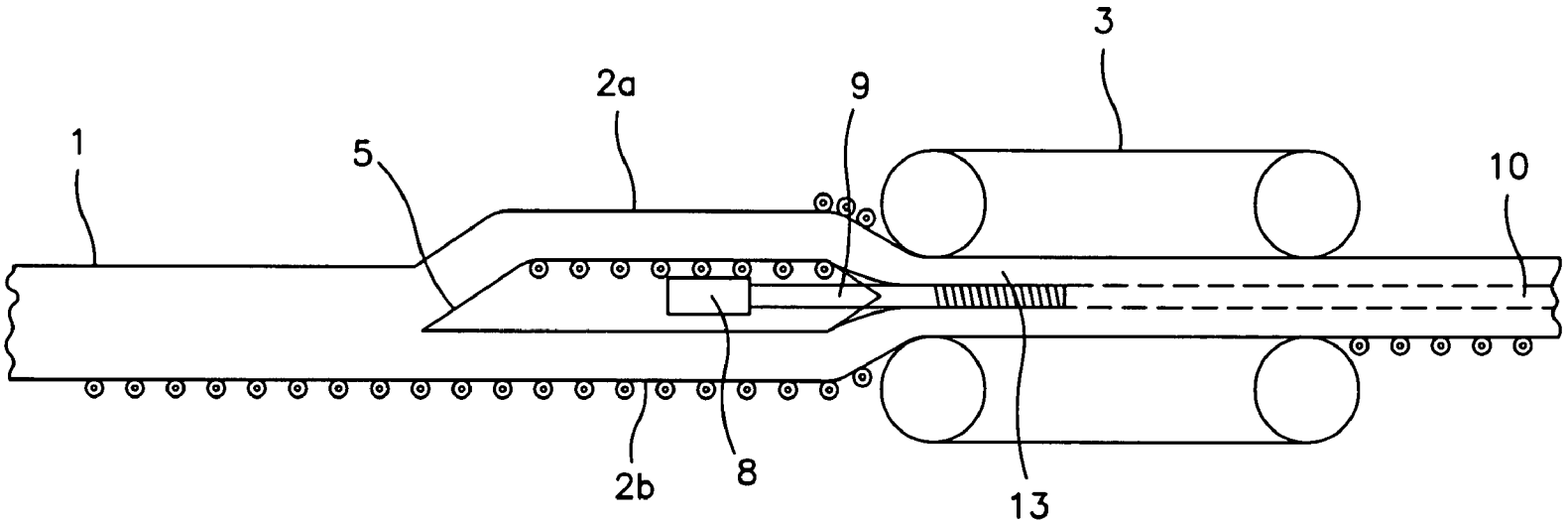
FIG. 3 shows an apparatus and process according to the invention where the shaped cavities are formed in the body of the web.

FIG. 3 shows an apparatus where the shaped cavities are formed in the body of the web. A web 1 is convoyed to pass a dividing tool 5 which divides the web 1 into a first sub-web 2*a* and a second sub-web 2*b*. The sub-webs 2*a* and 2*b* are convoyed in their longitudinal direction and brought together around moulding pieces 9 fastened to a support device 8. As the sub-webs 2*a* and 2*b* containing the moulding pieces are compressed by the compression means 3 and simultaneously hardened and cured, the sub-webs form a layered web with shaped cavities 10 in the body. The moulding piece 9 is supplied with nozzles 13 from which steam can pre-harden or pre-cure the web.

Figure 4:
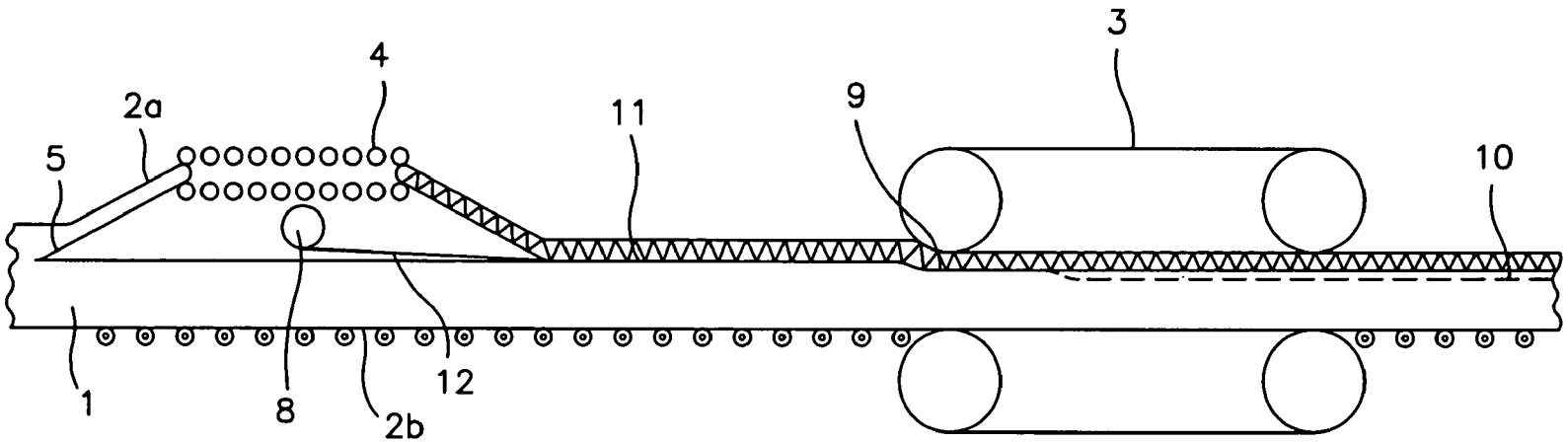
FIG. 4 shows an apparatus and process according to the invention for preparing a dual density product with shaped cavities.

In FIG. 4 a web 1 is convoyed to pass a dividing tool which divides the web into two sub-webs 2*a* and 2*b*. The upper sub-web 2*a* is convoyed to pass a set of rollers which compress the sub-web 2*a* to a density which is significantly higher than the density of the lower sub-web 2*b*. The sub-webs 2*a* and 2*b* are then brought together to form a layered web where moulding pieces are placed in the interface 11 between the sub-webs 2*a* and 2*b*. The moulding pieces form shaped cavities 10 in the layered web as it passes the compression means 3 and simultaneously is cured or hardened. The moulding pieces are fastened to the support device 8 by means of a line or rope 12 and the moulding pieces 9 may optionally be rolled up on the support device 8 when not in use.

Figure 5:
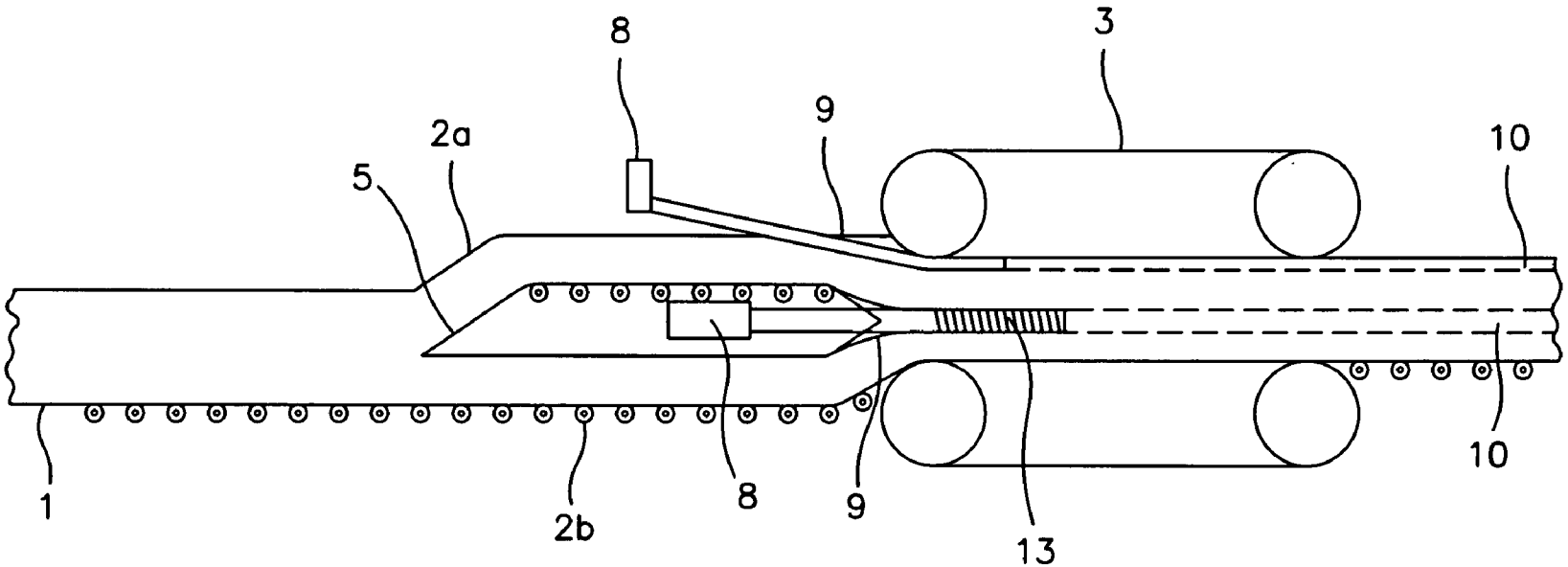
FIG. 5 shows an apparatus and process according to the invention where cavities are formed simultaneously in the surface and in the body of the web.

FIG. 5 shows a web 1 which is conveyed to pass a dividing tool 5 which divides the web 1 into an upper sub-web 2*a* and a lower sub-web 2*b*. The sub-webs 2*a* and 2*b* are the brought together to form a layered web and moulding pieces 9 are then placed in the upper surface of the sub-web 2*a* and in the interface between the sub-webs 2*a* and 2*b*. As the layered web is convoyed through the compression means 3 and simultaneously cured or hardened, shaped cavities 10 are formed in the upper surface and in the body of the layered web.

Figure 6A:
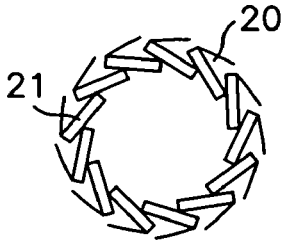
FIG. 6 shows a cross section of an embodiment of the moulding piece.
Figure 6B:
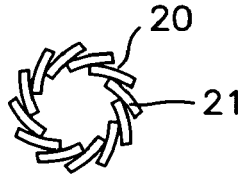

In FIG. 6 an embodiment of a moulding piece 20 is shown. The moulding piece consists of lammelas 21 which extend in the longitudinal direction of the moulding piece 20. The lammelas are slideable over each other which gives the advantages that the cross section area of the moulding piece may be varied during the production process and as seen in FIGS. 6*a* and 6*b*.

Figure 7:
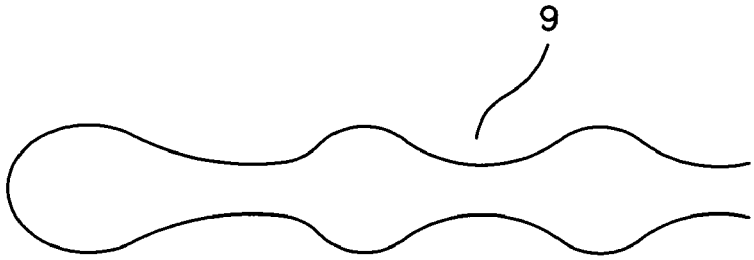
FIG. 7 shows an embodiment of a moulding piece according to the invention.

Of course the moulding piece can be constructed in many other ways. It may e.g. be of flexible material like rubber or plastic and have the size varied by inflating gas or liquid in the moulding piece. Furthermore the moulding pieces may have a varying cross section area over the length of the moulding piece as seen in FIG. 7 which shows an embodiment of a moulding piece 9 according to the invention.

The moulding piece may also be telescopic and having parts slidable into each other. In a very simple and cheap solution the moulding pieces are simply ropes e.g. from hemp or nylon. This also has the advantage that the moulding pieces can be rolled up on the support device when not in use. Similar advantages can be achieved by using rubber or plastic tubes as moulding pieces. In many cases it is preferred that the moulding pieces have a smooth surface, but in other cases it is preferred that the moulding piece has a rough surface. In order to facilitate the placing of the moulding pieces in the web it is an advantage to make cuts in the web with a knife or similar before the moulding pieces are placed in the web. The moulding pieces may also have a screw-shaped surface in order to facilitate it being placed in the wool. It is also possible to apply oil or grease to moulding pieces to facilitate the placing in the web.

Figure 8:
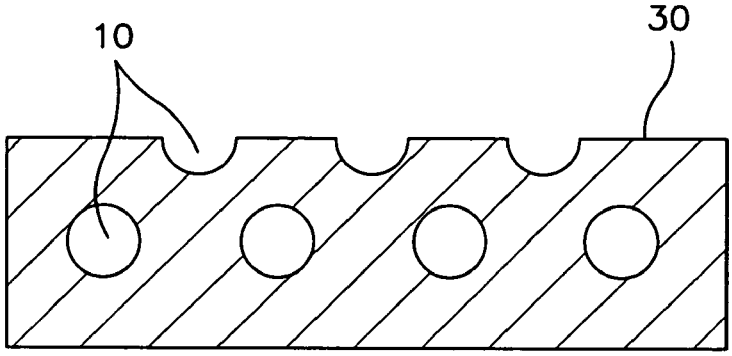
FIG. 8 shows the cross section of a panel produced according to the invention.

FIG. 8 shows a mineral fiber panel 30 with shaped cavities 10 prepared by the method according to the invention and with an apparatus according to the invention. Although the panel is only shown with shaped cavities in the body and one surface side it is obvious that the panel can prepared with shaped cavities in two surface sides.

Figure 9:
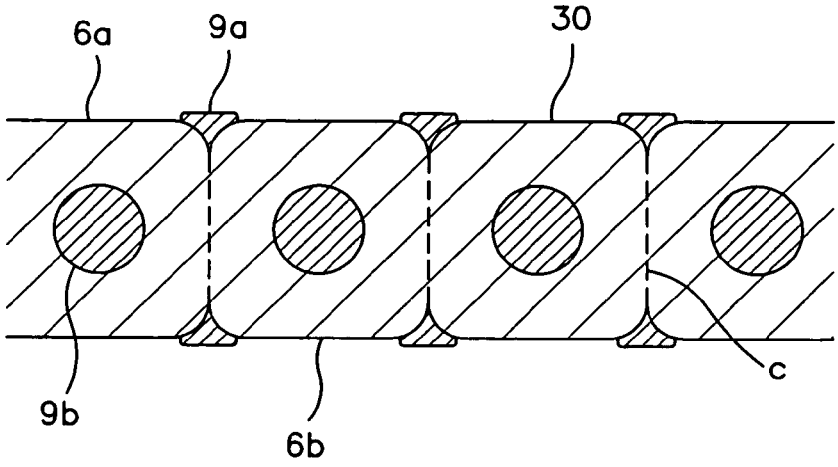
FIG. 9 shows another embodiment of a panel produced according to the invention.

FIG. 9 shows a cross section of the preparation of a mineral fiber panel according to the invention. The panel 30 is prepared by use of moulding pieces 9*a* with substantial triangular cross sections in the surfaces 6*a* and 6*b* of the panel. In the center of the panel is placed moulding pieces 9*b* with a substantial circular cross section. The cured or hardened panel may be cut in the longitudinal direction at the dotted lines c. The resulting product can be used for e.g. technical insulation.

Figure 10:
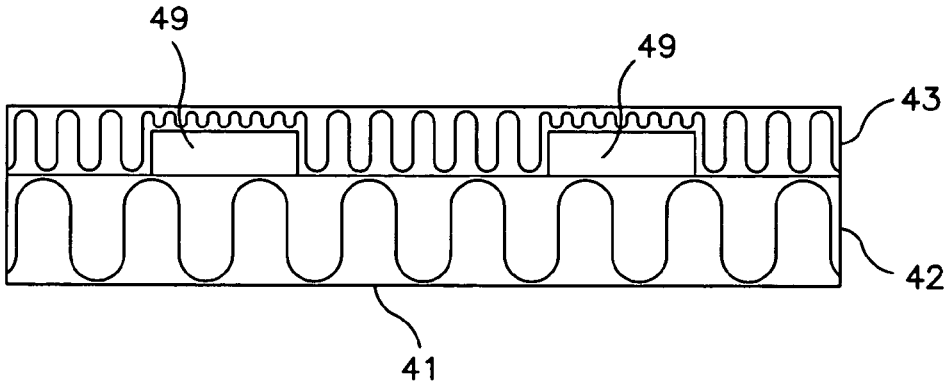
FIG. 10 shows a mineral fiber panel according to the invention useful for ventilated roof and facade insulation.

The mineral fiber panel according to the invention shown in FIG. 10 is useful for a ventilated roof and facade insulation. The panel 41 is produced with dual-density layers 42 and 43. The shaped cavities are formed by use of moulding pieces made of Teflon with a rectangular cross section with the dimensions: width 40 mm and height 20 mm. The uncured web is compressed around the moulding pieces which extend 1,5 m into the curing oven, whereby the panel with the shaped cavities 49 is formed.

The finishing panel had the following properties: shaped cavities extending in the whole length of the panel with dimensions 20×40 mm and with mutual spacing 150 mm and placed in the interface between the dual-density layers 42 and 43. The lower layer 42 has a density of 95 kg/m$^3$ and a thickness of 180 mm. The upper layer 43 has a density of 180 kg/m$^3$ and a thickness of 20 mm.

The panel has a length of 2000 mm, a width of 500 mm and a total thickness of 200 mm The panel was installed as roof panels on a low-sloped roof. The panels were installed in such a way that the shaped cavities ran continuously from one side of the building to the other side. The difference in the air pressure resulted in an airflow of a velocity of 1,01–0,15 m/s through the shaped cavities.

As the temperature in the shaped cavities was increased during the day, the potential for transporting moisture out of the construction was increased. Measurements showed that 0.6 kg of water was removed from the construction per meter per day.

Figure 11A:
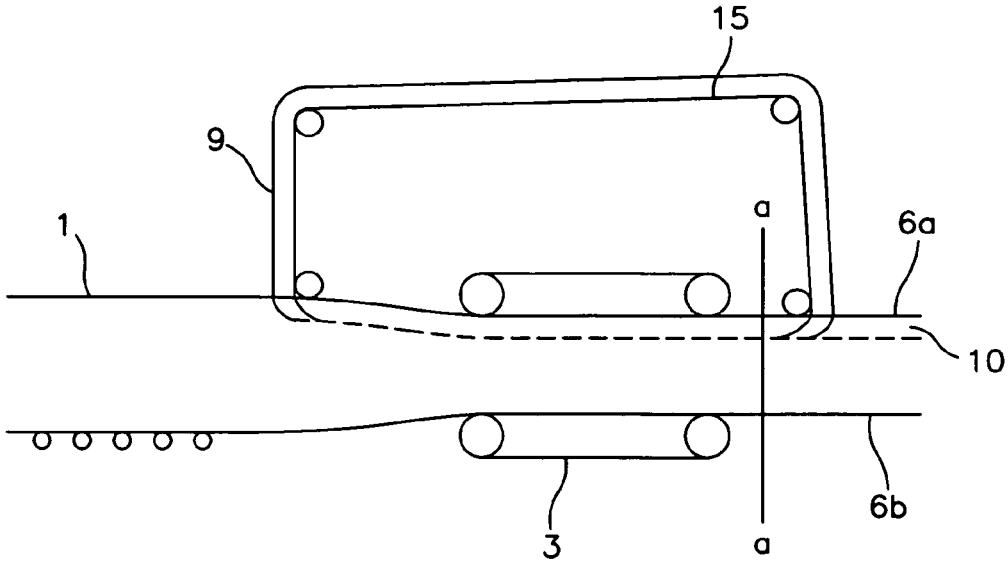
FIGS. 11*a* and 11*b* show a special embodiment for producing mineral fiber panels with shaped cavities in the surfaces according to the invention.
Figure 11B:
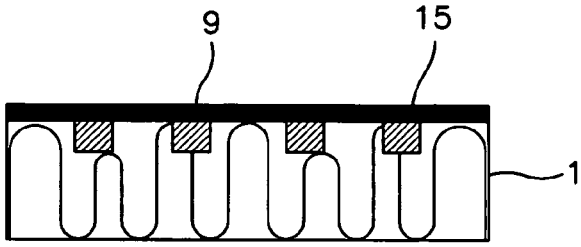

In FIGS. 11*a* and 11*b* show a special embodiment of producing mineral fiber panels with shaped cavities in the surfaces according to the invention. As seen in FIG. 11*a* the moulding pieces 9 are present in the surface 6*a* of the web 1 when the web is compressed and cured or hardened in the curing or hardening oven 3 and not removed until after the curing or hardening oven. The moulding pieces 9 are placed on a endless belt 15 which conveys the moulding pieces into the web 1 before the curing or hardening oven 3 and removes the moulding pieces after the curing or hardening oven.

In FIG. 11*b* a cross section along the line aa is shown. The moulding pieces 9 on the belt 15 are forming shaped cavities 10 in the web 1.

Figure 12:
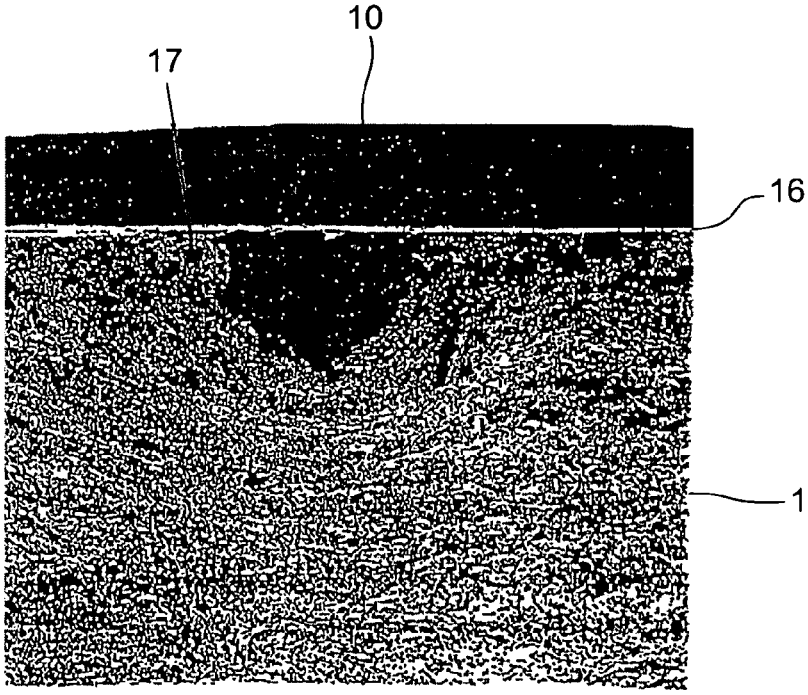
FIG. 12 shows a photograph of a cross section of a panel manufactured according to the invention.

FIG. 12 shows a photograph of the cross section of a panel produced according to the invention. The shaped cavity 10 in the web 1 is formed by a mould piece constituted by a hemp rope with a diameter of 24 mm. The web 1 is applied with vlies 16. The zone 17 around the shaped cavity where the fiber material is compressed more than the fiber material in the other part of the web is seen quite clearly. The photo is enlarged 1:41.

The examples given above are not in any way limiting the scope of the invention, as the skilled person is able to carry out the invention in many other ways.

The invention claimed is:

1. A method of preparing a mineral fiber panel comprising one or more shaped cavities, said method comprising steps of i) providing a mineral fiber web comprising an unhardened or uncured binding agent, and conveying said mineral fiber web in a longitudinal direction, ii) pressing one or more moulding pieces into a surface of said web and compressing a part of said web containing said moulding piece(s) in the surface, and iii) passing said partially compressed web containing moulding pieces into a hardening or curing oven for hardening or curing of said binding agent.

2. The method of claim 1, wherein said moulding piece(s) are placed into said surface prior to said compression.

3. The method of claim 1 or 2, wherein said hardened or cured web is cut into panels.

4. The method of claim 1, wherein said part of the web containing the moulding pieces is compressed during said hardening or curing.

5. The method of claim 1, comprising the steps of dividing said web into two or more sub-webs to form a layered web, introducing one or more moulding pieces in an interface between each sub-web, said one or more moulding pieces forming cavities in said layered web, and compressing said layered web containing said one or more moulding pieces.

6. The method of claim 5, wherein said part of the layered web containing the one or more moulding pieces is compressed simultaneously with said layered web being cured or hardened.

7. The method of claim 5, wherein said one or more moulding pieces are fastened to a support device placed between conveying means conveying a first and a second of said sub-webs, immediately before said sub-webs are brought together to form a layered web, said one or more moulding pieces extending from the support device in a direction of and parallel to a plane defined by said layered web.

8. The method of claim 1 or 7, wherein at least a number of said moulding pieces are fastened to one or more support devices placed above and/or under the web or the layered web.

9. The method of claim 1 or 5, wherein liquid and/or gas is led to said web or layered web through holes and/or nozzles in one or more of the moulding pieces.

10. The method of claim 1 or 5, wherein said one or more moulding pieces are heated or cooled.

11. The method of claim 1 or 5, wherein said one or more moulding pieces rotate and/or move forwards and back in a direction parallel to the direction of the web or the layered web and/or vibrate.

12. The method of claim 1 or 5, wherein said part of said web or layered web containing the one or more moulding pieces is compressed at an entrance to and/or in a hardening or curing oven.

13. A method of preparing a mineral fiber panel comprising one or more shaped cavities, said method comprising the steps of i) providing a mineral fiber web comprising unhardened or uncured binding agent and conveying the mineral fiber web in a longitudinal direction, ii) pressing one or more moulding pieces into a body of the web by dividing the web into two sub-webs, placing the moulding piece(s) between said sub-web and compressing a part of the web containing the moulding pieces(s) between the sub-webs, said one or more moulding pieces forming one or more shaped cavities in a final web, iii) hardening or curing the binding agent.

14. The method of claim 13, wherein said hardened or cured web is cut into panels.

15. The method of claim 13 or 14, comprising the step of bringing an upper and/or lower surface of said layered web in contact with one or more moulding pieces to form one or more shaped cavities in the upper and/or lower surface of said layered web, said layered web containing the one or more moulding pieces being compressed simultaneously with said layered web being cured or hardened.

16. The method of claim 13, wherein said one or more moulding pieces are fastened to a support device placed between conveying means conveying a first and a second of said sub-webs, immediately before the sub-webs are brought together to form a layered web, said one or more moulding pieces extending from the support device in a direction of and parallel to a plane defined by said layered web.

17. The method of claim 13, wherein at least a number of said moulding pieces are fastened to one or more support devices placed above and/or under the web or the layered web.

18. The method of claim 13, wherein liquid and/or gas is led to the web or the layered web through holes and/or nozzles in one or more of the moulding pieces.

19. The method of claim 13, wherein said one or more moulding pieces are heated or cooled.

20. The method of claim 13, wherein said one or more moulding pieces rotate and/or move forwards and back in a direction parallel to the direction of the web or the layered web and/or vibrate.

21. The method of claim 14, wherein said part of said layered web containing the one or more moulding pieces is compressed at the entrance to and/or in a hardening or curing oven.

22. A method for preparing a mineral fiber panel comprising one or more shaped cavities, said method comprising the steps of:

i) providing at least two mineral fiber sub-webs comprising an unhardened or uncured binding agent, and conveying said sub-webs in a longitudinal direction, ii) bringing said at least two sub-webs together to form a layered web and placing one or more moulding pieces in surface(s) of said sub-webs and in or into interface(s) between said sub-webs, said one or more moulding pieces forming one or more shaped cavities in the layered web, and iii) hardening or curing the binding agent.

23. The method of claim 22, wherein before said step ii) one or more of said at least two sub-webs is compressed.

24. The method of claim 22, wherein said hardened or cured web is cut into panels.

25. The method of claim 22 or 23, comprising the step of bringing an upper and/or lower surface of said layered web in contact with one or more moulding pieces to form one or more shaped cavities in the upper and/or lower surface of said layered web, said layered containing the one or more moulding pieces being compressed simultaneously with said layered web being cured or hardened.

26. The method of claim 22, wherein said one or more moulding pieces are fastened to a support device placed between conveying means conveying means conveying a first and a second of said sub-webs, immediately before the sub-webs are brought together to form a layered web, said one or more moulding pieces extending from the support device in the direction of and parallel to a plane defined by said layered web.

27. The method of claim 22, wherein at least a number of said moulding pieces are fastened to one or more support devices placed above and/or under the web or the layered web.

28. The method of claim 22, wherein liquid and/or gas is led to the web or the layered web through holes and/or nozzles in one or more of the moulding pieces.

29. The method of claim 22, wherein said one or more moulding pieces are heated or cooled.

30. The method of claim 22, wherein said one or more moulding pieces rotate and/or move forwards and back in a direction parallel to a direction of the web or the layered web and/or vibrate.

31. The method of claim 22, wherein said part of said layered web containing the one or more moulding pieces is compressed at an entrance to and/or in a hardening or curing oven.

32. A method for preparing a mineral fiber panel comprising one or more shaped cavities, said method comprising the steps of i) providing at least two mineral fiber sub-webs comprising an unhardened or uncured binding agent, and conveying said subwebs in a longitudinal direction, ii) bringing said at least two sub-webs together to form a layered web and placing one or more moulding pieces in or into interface(s) between said sub-webs, said one or more moulding pieces forming one or more shaped cavities in the layered web, and iii) hardening or curing the binding agent.

33. The method of claim 32, wherein before said step ii one or more of said at least two sub-webs is compressed.

34. The method of claim 32, wherein said hardened or cured web is cut into panels.

35. The method of claim 32 or 33, comprising the step of bringing an upper and/or lower surface of said layered web in contact with one or more moulding pieces to form one or more shaped cavities in an upper and/or lower surface of said layered web, said layered web containing the one or more moulding pieces being compressed simultaneously with said layered web being cured or hardened.

36. The method of claim 32, wherein said one or more moulding pieces are fastened to a support device placed between conveying means conveying a first and a second of said sub-webs, immediately before the sub-webs are brought together to form a layered web, said one or more moulding pieces extending from the support device in a direction of and parallel to a plane defined by said layered web.

37. The method of claim 32, wherein at least a number of said moulding pieces are fastened to one or more support devices placed above and/or under the web or the layered web.

38. The method of claim 32, wherein liquid and/or gas is led to the web or the layered web through holes and/or nozzles in one or more of the moulding pieces.

39. The method of claim 32, wherein said one or more moulding pieces are heated or cooled.

40. The method of claim 32, wherein said one or more moulding pieces rotate and/or move forwards and back in a direction parallel to the direction of the web or the layered web and/or vibrate.

41. The method of claim 32, wherein said part of said layered web containing the one or more moulding pieces is compressed at an entrance to and/or in a hardening or curing oven.

* * * * *